US006578347B1

(12) United States Patent
Abou-Nabout et al.

(10) Patent No.: US 6,578,347 B1
(45) Date of Patent: Jun. 17, 2003

(54) METHOD FOR PRODUCING A PACKAGING CONTAINER WITH A BINDING HAVING AN AUXILIARY PACKAGING COMPONENT

(75) Inventors: Adnan Abou-Nabout, Meerbusch (DE); Hassan Ahmed Nour Eldin, Dubendorf (CH)

(73) Assignee: Sopp GmbH & Co. KG, Remscheid (DE)

( * ) Notice: Subject to any disclaimer, the term of this patent is extended or adjusted under 35 U.S.C. 154(b) by 0 days.

(21) Appl. No.: 09/508,881

(22) PCT Filed: Sep. 18, 1998

(86) PCT No.: PCT/EP98/05981

§ 371 (c)(1),
(2), (4) Date: Jun. 2, 2000

(87) PCT Pub. No.: WO99/14128

PCT Pub. Date: Mar. 3, 1999

(30) Foreign Application Priority Data

Sep. 18, 1997 (DE) ..... 197 41 024

(51) Int. Cl.[7] ..... B65B 13/02
(52) U.S. Cl. ..... 53/399; 53/592
(58) Field of Search ..... 53/399, 414, 137.2, 53/138.6, 139.4, 592, 390; 100/9, 34; 428/4, 5

(56) References Cited

U.S. PATENT DOCUMENTS 2,133,278 A * 10/1938 Brogden ..... 53/137.2
2,514,038 A * 7/1950 Doolittle ..... 53/414
4,014,570 A * 3/1977 Ruggles et al. ..... 289/17
4,528,217 A * 7/1985 Spathis et al. ..... 428/5

FOREIGN PATENT DOCUMENTS

DE G8528613.3 * 5/1989

* cited by examiner

*Primary Examiner*—Stephen F. Gerrity
(74) *Attorney, Agent, or Firm*—Harness, Dickey & Pierce, P.L.C.

(57) ABSTRACT

A method of producing a packaging container, in particular for providing a box with a binding comprising a thread-like or strip-like auxiliary packaging component, such as a band or the like, and for decorating the packaging container with a bow. In order to make the method more flexible, in particular in order to allow partial automation, according to the invention, first of all a carrier is prefabricated with the auxiliary packaging component, and then the auxiliary packaging mechanism is transferred from the carrier to the packaging apparatus.

15 Claims, 8 Drawing Sheets

20
22
10
$L_{VK}$
26
27
$A_{VK}$
24
25
28
29
23
21
$B_{VK}$

METHOD FOR PRODUCING A PACKAGING CONTAINER WITH A BINDING HAVING AN AUXILIARY PACKAGING COMPONENT

This application is a National Stage filing under 35 U.S.C. §371 of International Application No. PCT/EP98/05981, which has an international filing date of Sep. 18, 1998 and which designated the United States of America.

BACKGROUND OF THE INVENTION

1. Technical Field of the Invention

The present invention relates to a method of producing a packaging container, in particular for providing a box with a binding comprising a thread-like or strip-like auxiliary packaging means, such as a string, a band or the like, and for decorating the packaging container with a bow. The invention also relates to the technical means for implementing such a method.

2. Discussion

In addition to the function of protecting the packaged goods from losses in quality and of simplifying storage and transportation, packaging also makes possible a mass-produced get-up of the packaged product and provides possible ways of designing it for advertising purposes. One of these possible ways is not just to provide a packaging container with a binding, but also to decorate it with a bow. Such attractive packaging is important, in particular, for goods which are often intended as a gift, such as chocolate or chocolates. The latter are usually packaged in boxes which may be of different configurations but, in the simplest and most common cases, are of cuboidal design. Where foodstuffs or (semi-) luxury goods are concerned, metallic auxiliary means, such as staples or the like, must not be used for the packaging.

While, in order to make bindings for, for example, cuboidal packaging containers, automatic and semiautomatic binding machines, by means of which bands, wires, cords, etc. with lead seals, staples, twisting, knots and/or adhesive bonding are provided as closures, are known, the operation of tying a bow is more difficult to automate. The ends of a thread-like or strip-like auxiliary packaging means, such as a string, a band or the like, have to be formed into loops, and intertwined in a certain way, in order to decorate a packaging container with a bow. In this case, it is essential, for attractive packaging, for the bow to be perfectly formed. The book "Geschenke liebevoll verpacken" [Gifts lovingly packed], Remseck, Stuttgart, 1997 gives, for example on pages 92–115, instructions which comprise individual working steps and are intended for different ways of positioning bands and for tying bows. This way of producing the packaging usually takes place—even if large numbers of packaging units are manufactured—manually and involves a considerable amount of work. For this purpose, the thread-like or strip-like auxiliary packaging means is, for example at the factory, cut to size from materials supplied by the meter, bound and tied into bows. For a high production throughput, a very large number of workers have to be involved with this work.

The object of the present invention is thus, while maintaining a high quality for the packaging container produced, to make a method of the type mentioned in the introduction more flexible in order thus, during manufacture, to achieve a cost advantage and/or to make it possible for the method to be partially automated. A further object of the invention is to provide the technical means for implementing such a method.

This object is achieved by a production method of the type mentioned in the introduction in the case of which first of all a carrier is prefabricated with the auxiliary packaging means, and then the auxiliary packaging means is transferred from the carrier to the packaging container. Also specified in order to achieve the object are a carrier according to the invention, a prefabricating arrangement according to the invention and a prefabricated unit according to the invention.

The technical solution according to the invention is based on the idea of achieving the sought-after flexibility by dividing up the production operation into individual sub-operations which can be carried out separately from one another in terms of space and time. In this case, the last sub-operation, the transfer of the binding with the bow from the carrier to the packaging container, can be automated more easily than the production process overall.

This produces the prefabricated unit according to the invention which is intended for the packaging container and comprises the carrier and the thread-like or strip-like auxiliary packaging means, it being the case that the latter, following the first production sub-operation, forming a binding and provided with a bow, is fastened on the carrier. Such a prefabricated unit can easily be transported and stored in a magazine for further processing at a later date.

In the case of the method according to the invention, an elastically extendible thread-like or strip-like auxiliary packaging means can be used and, in order to transfer this auxiliary packaging means from the carrier to the packaging container, the carrier with the binding, which is formed by the prefabricating operation, is provided with the bow and comprises the thread-like or strip-like auxiliary packaging means, can be positioned on the top side or underside of the packaging container, with the packaging container being guided at least partially between the binding and the carrier, then the binding is slipped off from the carrier and, in its entirety, slipped over the packaging container and, finally, the carrier is removed from the binding and the packaging container.

In this case, the carrier can be prefabricated either just using the carrier or with the aid of an additional production arrangement according to the invention. Using a production arrangement brings about further material-saving advantages, in particular when a disposable carrier is used.

In order to implement the method according to the invention, a carrier which is constructed from, in particular, a flexible material and has a planar basic shape adapted to the packaging container is preferably suitable, it being the case that a height dimension of the carrier is smaller than a height dimension of the packaging container and, should a prefabricating arrangement be used, is preferably also smaller than a height dimension of the same. The height dimension of the carrier may preferably just be a fraction of the height dimension of the packaging container. At least one planar basic dimension of the carrier, such as length or width, should be obtained in each case, for example, from a corresponding planar basic dimension, such as length or width, of the packaging container plus at least in each case the height dimension of the packaging container.

In order to implement the method according to the invention, it is advantageously possible to use a prefabricating arrangement which is, in particular, constructed from a rigid material and has a planar basic shape adapted to the packaging container, it being the case that a height dimension of the prefabricating arrangement is smaller than a height dimension of the packaging container, and the planar basic dimensions, such as length and width, are obtained in each case, for example, from a corresponding planar basic dimension, such as length and width, of the packaging container plus at least in each case the height dimension of the packaging container. However, it is possible for the height dimension of the prefabricating arrangement to be greater than the height dimension of the carrier.

It is preferably possible to use such a carrier and such a prefabricating arrangement which, in their respective planar configuration, are congruent with one another in a sub-region.

In order to implement the method according to the invention, it is also possible to use a fabricating arrangement according to the invention which has a retaining arrangement for a packaging container and for a prefabricated unit and also has a plurality of movable grippers for gripping the binding.

BRIEF DESCRIPTION OF THE DRAWINGS

Further features and advantages of the invention will become apparent from the following discussion and accompanying drawings, in which.

DETAILED DESCRIPTION OF THE PREFERRED EMBODIMENT

The following description of the preferred embodiment is merely exemplary in nature, and is in no way intended to limit the invention or its application or uses.

Figure 1:
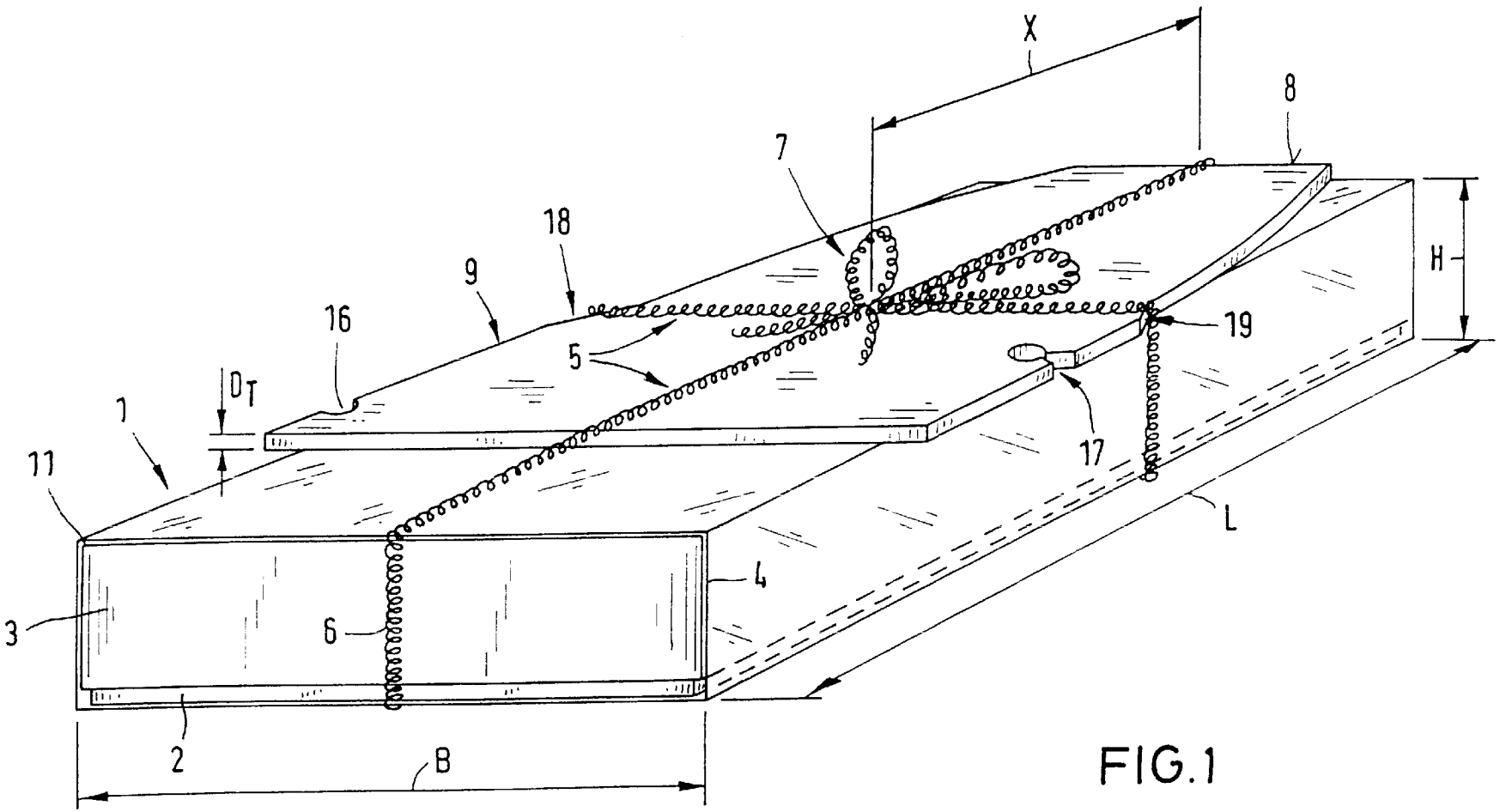
FIG. 1 is a perspective view of a box which has been virtually finished according to the invention and has a carrier used for production purposes.

FIG. 1 shows, as an example of a packaging container 1, an essentially cuboidal box which has been virtually finished according to the invention and has a length L, a width B and a height H. The box comprises a base part 2, on which a lid part 3 is positioned, and is enclosed by a sleeve 4 made of cellophane. The packaging container 1 is provided with a binding 5 by a thread-like or strip-like auxiliary packaging means 6, such as a string, a band, or the like and, for decorative purposes, has a bow 7. In the present case, the auxiliary packaging means 6 is a string. The binding 5 is in the form of cross-binding. However, it could also be executed in the form of diagonal binding or triangular binding.

The bow 7 is tied using the auxiliary packaging means 6 serving for binding purposes. The bow 7 may be designed as a single or multiple bow, a decorative bow or a knotted bow. In the exemplary embodiment, the bow 7 is spaced apart from an end side 8 of the box by a distance X which is approximately 30 to 40 per cent of the length L of the box. Such a position X of the bow 7 corresponds to the so-called "golden section" and is particularly aesthetically pleasing.

Figure 2:
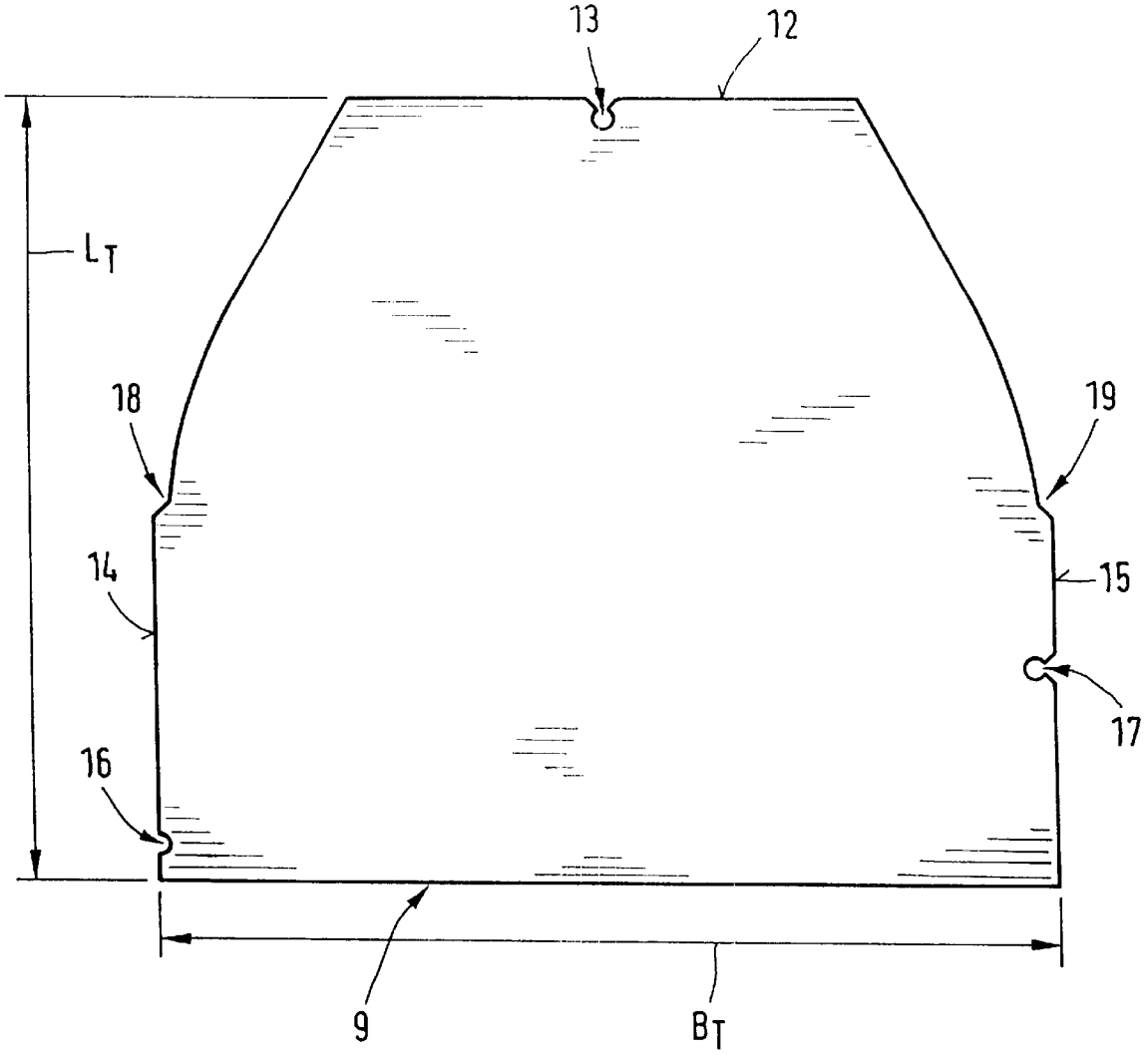
FIG. 2 is a plan view of a carrier according to the invention for implementing a method according to the invention.

A packaging container produced in such a way is manufactured according to the invention in that first of all a carrier 9, as a single part by way of example in FIG. 2, is prefabricated with the auxiliary packaging means 6, and then the auxiliary packaging means 6 is transferred from the carrier 9 to the packaging container 1.

In order to transfer the auxiliary packaging means 6 from the carrier 9 to the packaging container 1, the carrier 9 with the binding 5, which is formed by the prefabricating operation, is provided with the bow 7 and comprises the thread-like or strip-like auxiliary packaging means 6, may be positioned, for example, on the top side, as is illustrated in FIG. 1, or else on the underside of the packaging container 1, with the packaging container 1 being guided at least partially between the binding 5 and the carrier 9, then the binding 5 is slipped off from the carrier 9 and, in its entirety, slipped over the packaging container 1 and, finally, the carrier 9 is removed from the binding 5 and the packaging container 1. This last step also has to be carried out with the carrier 9 illustrated in FIG. 1 in order to obtain a packaging container 1 which has been fully finished according to the invention.

Figure 3:
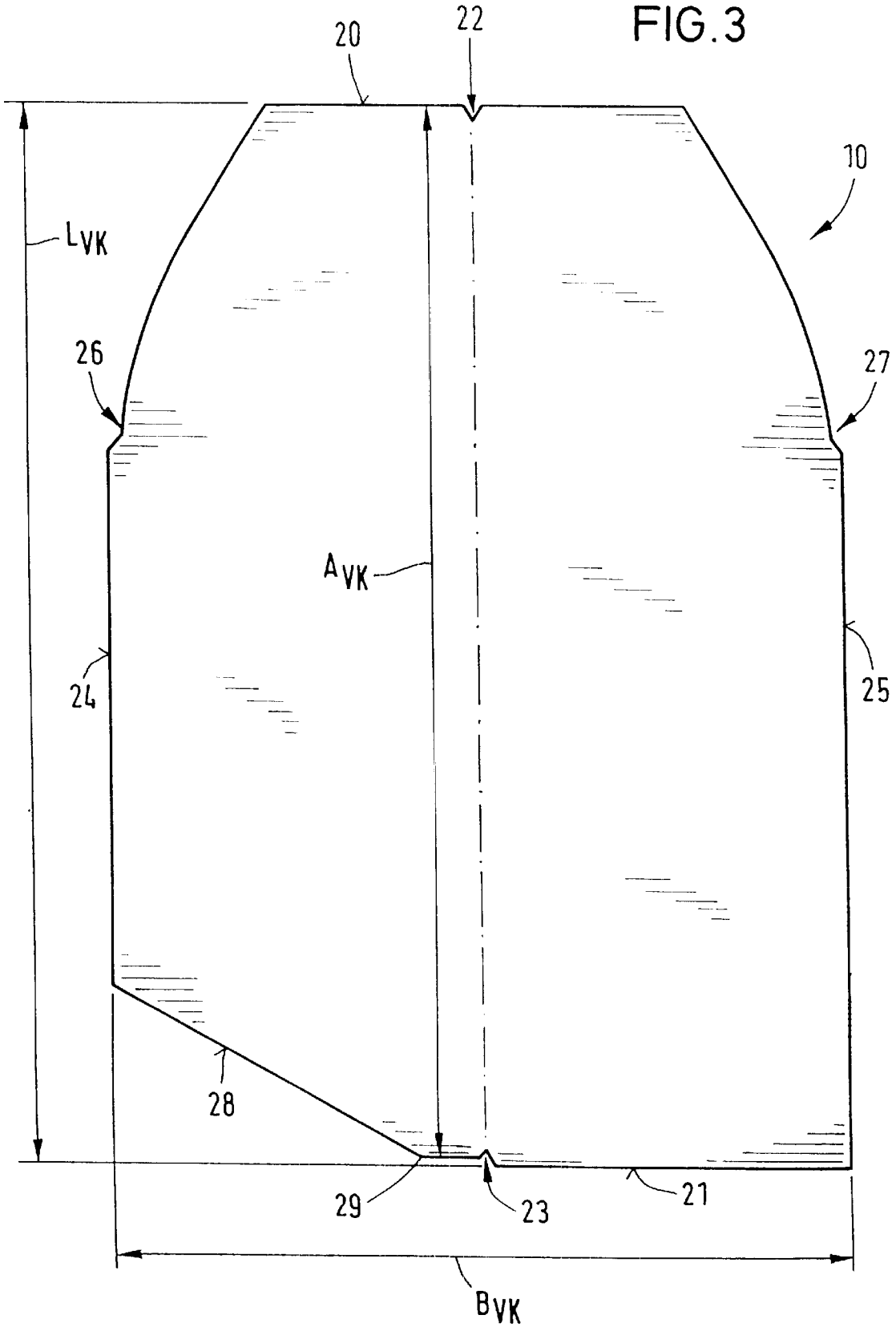
FIG. 3 is a plan view of a prefabricating arrangement according to the invention for implementing a method according to the invention.

As has already been mentioned, the carrier 9 may be prefabricated either just using the carrier 9 or else with the aid of an additional prefabricating arrangement 10, as is illustrated as a single part by way of example in FIG. 3. In this case, in order to prefabricate the carrier 9, first of all the auxiliary packaging means 6, in the same way as for the binding 5 provided with the packaging container 1 and illustrated, for example, in FIG. 1, is bound around the prefabricating arrangement 10, provided with the bow 7 and then transferred from there to the carrier 9.

In order to transfer the auxiliary packaging means 6 from the prefabricating arrangement 10 to the carrier 9, the carrier 9 may be positioned on the top side or underside of the prefabricating arrangement 10. In this case, the carrier 9 is guided at least partially between the binding 5 and the prefabricating arrangement 10, then the binding 5 is slipped off from the prefabricating arrangement 10 and, in its entirety, slipped over the carrier 9 and fastened thereon.

Finally, the prefabricating arrangement 10 is removed from the binding 5 and the carrier 9.

It is expedient here, for a good grip on the carrier 9, for the thread-like or strip-like auxiliary packaging means 6 to be applied to the carrier 9, or even to the prefabricating arrangement 10, under prestressing. Use is thus made of an elastically extendible thread-like or strip-like auxiliary packaging means 6. The elasticity of the auxiliary packaging means 6 also makes it possible for the packaging container to be guided between the binding 5 and the carrier 9 without difficulty. When the carrier 9 is removed from the binding 5, which has already been slipped over the packaging container 1 and extended slightly by the prestressing, and from the packaging container 1, the auxiliary packaging means 6 can contract elastically again and form a sufficiently firm binding 5 around the packaging container 1.

If one takes as the departure point a box as the packaging container 1 as has been described above and illustrated in FIG. 1, then it is possible to estimate a preferably recommended percentage extendibility of the auxiliary packaging means 6: assuming that, during the transfer of the finished binding 5, provided with a bow 7, from the carrier 9 to the packaging container 1, the binding 5 is drawn over a comer 1I of the packaging container, use should be made of an auxiliary packaging means 6 which has at least approximately a percentage extendibility by an amount F, which can be calculated as $$F = \left(\frac{z}{y} - 1\right) * 100\%$$

The variable Z here is an extended length of the auxiliary packaging means 6 and can be calculated as $$Z=(0.25B^2+L^2)^{0.5}+[0.25B^2+(L-X)^2]^{0.5}+H$$

The variable Y here is an unextended length of the auxiliary packaging means 6 and can be calculated as $$Y=2L-X+H$$

(For a somewhat rougher estimate of this extendibility, it is also possible to leave out the summand H from the above second and third equations).

FIG. 2 shows, in the plan view, a carrier 9 according to the invention for implementing a method according to the invention. The carrier 9 preferably consists of a flexible material and has a planar basic shape adapted to the packaging container 1. Its height dimension (thickness $D_T$—FIG. 1) is smaller than a height dimension (height H) of the packaging container 1. If, as in the exemplary embodiment illustrated here, a prefabricating arrangement 10 is to be used, then the thickness $D_T$ of the carrier 9 should preferably also be smaller than a corresponding height dimension of the prefabricating arrangement 10. This height dimension of the prefabricating arrangement 10 is preferably the thickness (not illustrated in the drawing) of the prefabricating arrangement 10 shown in FIG. 3 and is designated $D_{VK}$ hereinbelow. At least one planar basic dimension (length $L_T$, width $B_T$) of the carrier 9 should be attained in each case, for example, from a corresponding planar basic dimension (length L, width B) of the packaging container 1 plus at least in each case the height dimension (height H) of the packaging container 1.

If no prefabricating arrangement 10 is used, the two planar basic dimensions (length $L_T$, width $B_T$) of the carrier 9 should be attained in each case, for example, from a corresponding planar basic dimension (length L, width B) of the packaging container 1 plus at least in each case the height dimension (height H) of the packaging container 1. This means that, when a prefabricating arrangement 10 is used, the carrier 9 may be designed, in a material-saving manner, to be shorter in one of its planar basic dimensions (in the example described—in its length $L_T$). The carrier 9 described is characterized by a planar basic dimension, to be precise its largest planar basic dimension (length $L_T$), which is smaller approximately by a third than the corresponding planar basic dimension (length L, $L_{VK}$; width B, $B_{VK}$) both of the packaging container 1 (FIG. 1) and of the prefabricating arrangement 10 (FIG. 3).

In order to apply the elastically extendible thread-like or strip-like auxiliary packaging means 6 to the carrier 9 under prestressing, but then to apply it to the packaging container 1 in a state in which it is subjected to virtually no stressing or barely any stressing, it is expedient if at least one planar basic dimension (length $L_T$ and/or width $B_T$) is larger than the value specified above by the envisaged amount of extension of the elastically extendible thread-like or strip-like auxiliary packaging means 6. If no prefabricating arrangement 10 is used, the two planar basic dimensions (length $L_T$ and width $B_T$) should be larger than the value specified above by the envisaged amount of expansion of the elastically extendible thread-like or strip-like auxiliary packaging means 6. In this case, the carrier 9 could be constructed, for example, in the same way as the prefabricating arrangement 10 described hereinbelow.

The carrier 9 according to the invention has, on one end side 12, a groove-like cutout 13 for at least partially accommodating the auxiliary packaging means 6. The cutout 13 is preferably designed as a round hole provided with a conically tapering slit. A groove-like cutout 16, 17 is also provided in each case on the two longitudinal sides 14, 15 of the carrier 9. One of these cutouts 17 is likewise designed as a round hole provided with a conically tapering slit; the other cutout 16 has the contour of a semicircular surface. The groove-like cutouts 13, 16, 17 are intended for accommodating the thread-like or strip-like auxiliary packaging means 6, which is gripped particularly well in the round holes provided with a slit in each case.

Recesses 18, 19 which are open obliquely in the direction of an end side 12 are also provided on the two longitudinal sides 14, 15 of the carrier 9. These recesses 18, 19 are likewise intended for accommodating the thread-like or strip-like auxiliary packaging means 6, but allow the latter to be slipped off particularly easily in the direction of the end side 12 of the carrier 9, the recesses being opened in the direction of said end side.

The two longitudinal sides 14, 15 preferably run towards one another in the direction of an end side 12, starting from their recesses 18, 19. This configuration in which the carrier 9 tapers on one side likewise helps the binding 5, which is formed from the thread-like or strip-like auxiliary packaging means 6, to be slipped off easily in the direction of the end side 12 of the carrier 9.

Since the longitudinal sides 14, 15 of the carrier 9 run towards one another, starting from the recesses 18, 19, the recesses 18, 19 have an essentially obtuse-angled contour and thus form abutment edges for the auxiliary packaging means 6 over the height $H_T$ of the carrier 9.

The carrier 9 may advantageously be manufactured from cardboard or paperboard, preferably from a solid board having a height dimension (thickness $D_T$) of approximately 0.3 to 0.7 mm. It may also be manufactured from plastic. Using such materials also provides the possibility of reuse and of straightforward recycling.

FIG. 3 shows a plan view of a prefabricating arrangement 10 according to the invention for implementing a method according to the invention. Unlike the carrier 9, the prefabricating arrangement 10 is constructed, in particular, from a rigid material. Like the carrier 9, the prefabricating arrangement 10 also has a planar basic shape adapted to the packaging container 1, it being the case that a height dimension (thickness $D_{VK}$) is smaller than a height dimension (height H) of the packaging container 1. The planar basic dimensions (length $L_{VK}$, width $B_{VK}$) are obtained in each case, for example, from a corresponding planar basic dimension (length L, width B) of the packaging container 1 plus at least in each case the height dimension (height H) of the packaging container 1.

For the same reasons as have been explained above for the carrier 9, it is also expedient in the case of the prefabricating arrangement 10 if at least one planar basic dimension (length $L_{VK}$, width $B_{VK}$) is increased by an amount of extension of the elastically extendible thread-like or strip-like auxiliary packaging means 6.

The prefabricating arrangement 10 has in each case one groove-like cutout 22, 23, preferably notched in the form of a V, on its two end sides 20, 21. These groove-like cutouts 22, 23 are intended for accommodating the thread-like or strip-like auxiliary packaging means 6, which, on the one hand, is gripped well in the V-shaped notches, but, on the other hand, can also easily be removed again from the cutouts 22, 23 for transfer to the carrier 9. During binding of the prefabricating arrangement 10, the groove-like cutouts 22, 23 also ensure centering of the auxiliary packaging means 6.

Furthermore, just as with the carrier 9, recesses 26, 27 which are open obliquely in the direction of an end side 20 are provided on the two longitudinal sides 24, 25 of the prefabricating arrangement 10. These recesses 26, 27 fulfil the same function as the recesses 18, 19 on the carrier 9.

In a manner analogous to the carrier 9, and with the same aim as described for the carrier 9 (making it easier to slip off the binding 5), the two longitudinal sides 24, 25 also run towards one another in the direction of an end side 20, preferably starting from the recesses 26, 27.

Here too, since the longitudinal sides 24, 25 of the prefabricating arrangement run towards one another, the recesses 26, 27 have an essentially obtuse-angled contour and form abutment edges for the auxiliary packaging means 6 over the height $H_{VK}$ of the prefabricating arrangement 10.

It can be gathered from all of this that the carrier 9 and the prefabricating arrangement 10 are preferably each of a planar configuration, and these are essentially congruent to one another in a sub-region (with the exception of the shape of the cutouts 13 and 22). In this case, the congruent sub-region comprises at least in each case one end side 12 or 20 and the region where the longitudinal sides 14 and 24; 15 and 25 run towards one another in each case, including the recesses 18 and 26; 19 and 27. This congruence specifically helps the transfer of the binding 5 from the prefabricating arrangement 10 to the carrier 9.

As FIG. 3 illustrates, there is also provided on the prefabricating arrangement 10 an oblique side 28 which runs in the left-hand half of the prefabricating arrangement, as seen in the drawing, from an end side 21 to a longitudinal side 24. In this case, the end side 21 in this half is preferably spaced apart, in the region of its edge 29 with the oblique side 28 to the groove-like cutout 23 located in it, from the other end side 20 by a distance $A_{VK}$ which is shorter than the overall length $L_{VK}$ of the prefabricating arrangement 10 approximately by half the depth of the cutout 23. This design means that the binding 5 formed on the prefabricating arrangement 10 can be slipped off from the prefabricating arrangement 10 with just a small number of movements, and without the auxiliary packaging means being over-extended, in order to transfer it to the carrier 9. For this purpose, said binding can easily be removed from the groove-like cutout 23 and guided, over that part of the end side 21 which is spaced apart by a smaller distance, to the edge 29 with the oblique surface 28, and then over the oblique surface 28 itself.

If it is intended to produce, as packaging containers 1, boxes having a height of approximately 30 mm, the prefabricating arrangement 10 may advantageously be manufactured from a plastic having a height dimension (thickness $D_{VK}$) preferably in the range of approximately 3 to 7 mm. If the plastic used is a preferably transparent plastic, such as PMMA or POM, this additionally makes it easier to see the respective position of the auxiliary packaging means 6 on the front side and rear side of the prefabricating arrangement 10.

Figure 4:
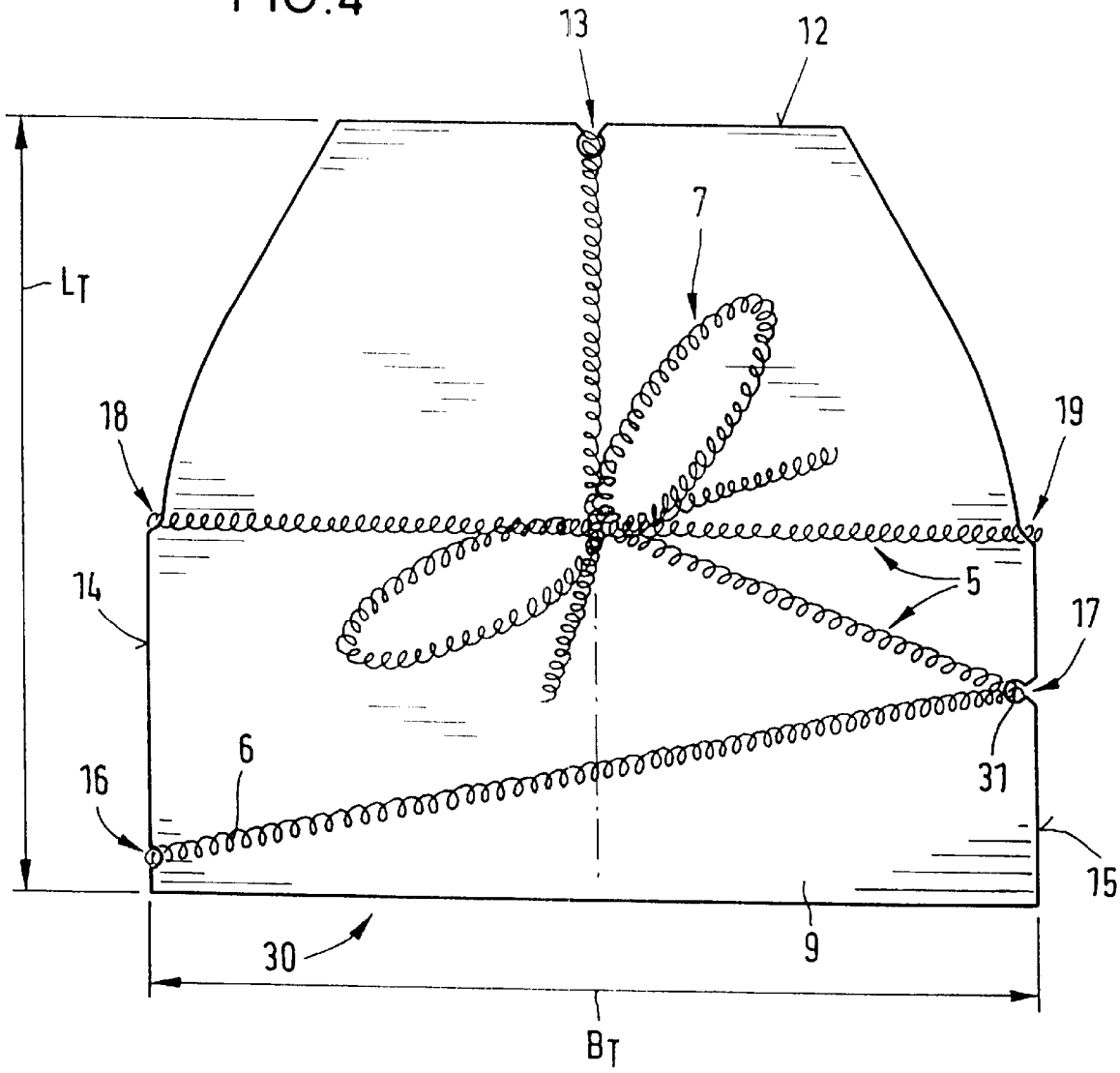
FIG. 4 is a plan view of a prefabricated unit according to the invention which, using a carrier according to FIG. 2, is provided with a binding, and decorated with a bow, according to the invention.
Figure 5:
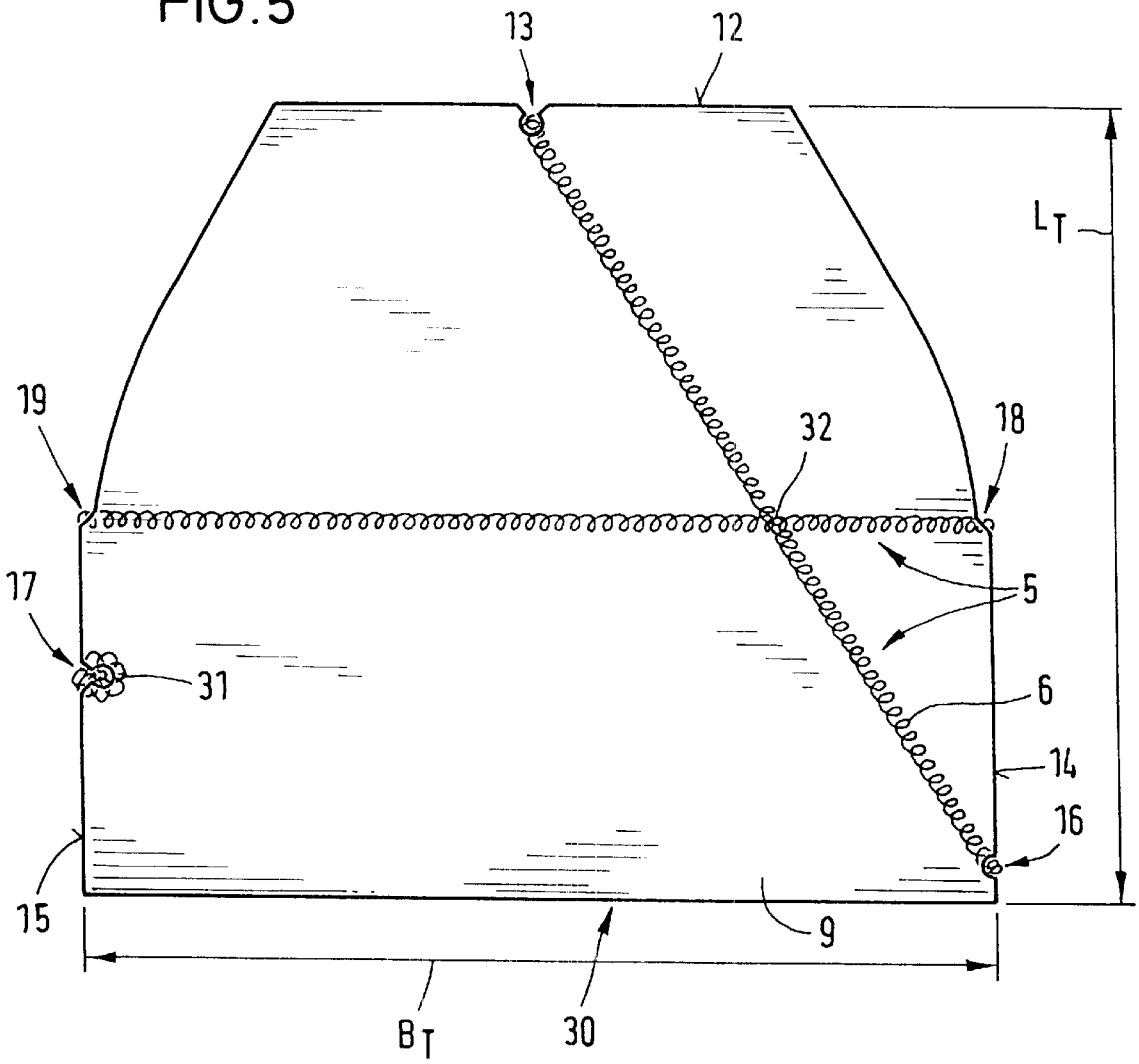
FIG. 5 is a bottom view of the prefabricated unit according to the invention illustrated in FIG. 4.

FIGS. 4 and 5 show the front side and rear side of a prefabricated unit 30 according to the invention for a packaging container 1 as is produced following transfer of a binding 5, including the bow 7, from a prefabricating arrangement 10 to a carrier 9. The prefabricated unit 30 comprises the carrier 9 and the thread-like or strip-like auxiliary packaging means 6 (string). The auxiliary packaging means 6, forming the binding 5 and provided with the bow 7, is fastened on the carrier 9.

The binding 5 has been executed on the prefabricating arrangement 10, in the same way as is provided at a later stage for the packaging container 1, in the form of cross-binding, provided with the bow 7 and then transferred to the carrier 9 in the manner described. In this case, that part of the binding 5 which runs along the length $L_{VK}$ of the prefabricating arrangement 10 was transferred, on an end side 20 or 12, from the cutout 22 of the prefabricating arrangement 10 to the cutout 13 of the carrier 9. That part of the binding 5 which runs along the width $B_{VK}$ of the prefabricating arrangement 10 was transferred from the recesses 26, 27 of the prefabricating arrangement 10 to the respectively congruent recesses 18, 19 and is retained between these recesses 18, 19 on the prefabricated unit 30, under slight prestressing.

As has already been mentioned, the carrier 9, in its length $L_T$, is smaller by at least approximately a third than the length $L_{VK}$ of the prefabricating arrangement 10. That part of the binding 5 which runs, through the cutout 23 on the bottom end side 21, as seen in FIG. 3, of the prefabricating arrangement, along the length $L_{VK}$ of the prefabricating arrangement 10 thus cannot be brought into a corresponding cutout of the carrier 9. Instead, a section of this part, once it has been slipped off from the prefabricating arrangement 10, on the one hand, is displaced laterally towards the longitudinal side 14 (which is on the left in FIG. 4) of the carrier 9 and is guided through the cutout 16 with the semicircular contour located there. On the other hand, a second section of this part is formed into a loop 31 which is fitted into the cutout 17 on the longitudinal side 15 (which is on the right in FIG. 4) of the carrier 9. This results in the string being guided on the front side of the carrier as is illustrated in FIG. 4. In order to transfer the binding 5 from the carrier 9 to the packaging container 1, the loop 31 can easily be removed again from the cutout 17.

FIG. 5 illustrates the course taken by the binding on the rear side of the carrier 9. The binding 5, which is formed from the thread-like or strip-like auxiliary packaging means 6 (string), is also retained under slight prestressing on the rear side of the carrier, running over the width $B_T$ of the carrier 9 between the two recesses 18, 19. That part of the cross binding of the string which later runs along the length L of the packaging container 1 instead runs obliquely over the rear side of the carrier—beginning in the cutout 13 on the end side 12 (which is at the top in FIG. 5) and ending in the groove 16 with the semicircular contour on the longitudinal side 14 (which is on the right in FIG. 5) of the carrier 9.

In order to ensure that the binding 5 can be displaced more easily, those parts of the cross-binding which later run along the length L of the packaging container 1 and along the width B of the same are not intertwined at their crossover point 32 on the rear side of the carrier 9.

Moreover, it is also possible to see—as well as a section of that part of the cross-binding of the string which later runs along the length L of the packaging container 1—on the other longitudinal side 15 (which is on the left in FIG. 5) of the carrier 9, the loop 31, of the binding 5, which is fitted in the cutout 17 located there.

As FIGS. 4 and 5 show, the course of the auxiliary packaging means 6 on the prefabricated unit 30 is advantageously selected such that one side, namely the end side 33, of the carrier 9 remains free of the binding 5. For production purposes, the packaging container 1 can easily be guided between the binding 5 and the carrier 9 via said free end side 33.

Starting from this prefabricated unit 30, which can easily be transported, stored on an intermediate basis and kept in stock for as long as desired, it is possible, with just a small number of movements, to finish off a packaging container 1, but it is also possible, on the other hand, to use, for this purpose, a production apparatus 100 according to the invention, of which the construction and operation are described hereinbelow. You are referred here, by way of example, to the above described prefabricated unit 30, although a production apparatus 100 according to the invention may also be designed such that it is possible to use prefabricated units of a different shape and which take a different course and in which the binding 5 is fastened on the carrier 9 in some other way.

Figure 6:
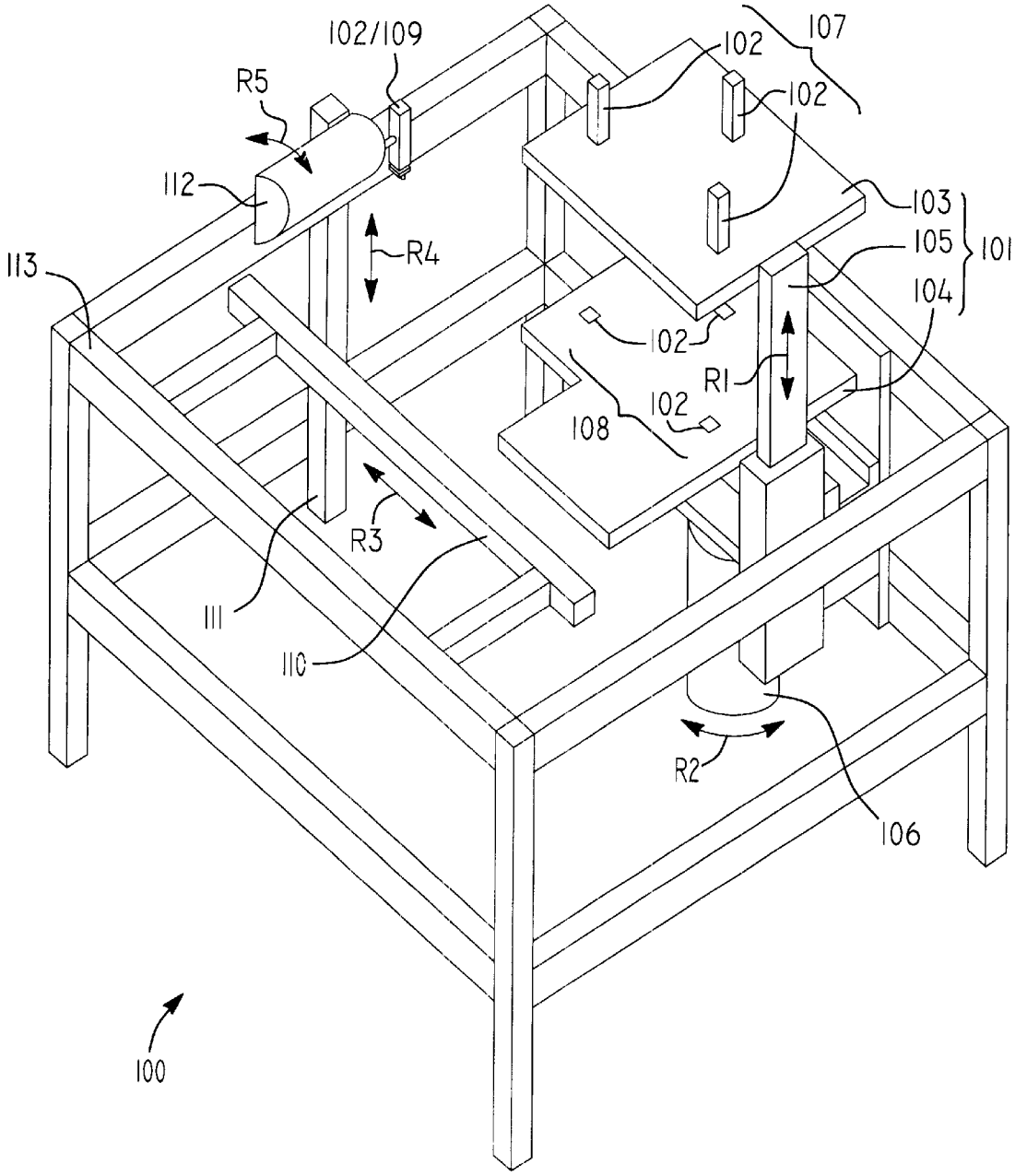
FIG. 6 is a schematic, perspective view of a production arrangement according to the invention for implementing a method according to the invention.

FIG. 6 illustrates the basic construction of the production apparatus 100 according to the invention. As the parts which are most important from a functional point of view, the production apparatus has, on the one hand, a retaining arrangement 101 for the packaging container 1 and for a prefabricated unit 30 and, on the other hand, a plurality of movable grippers 102 for gripping and spreading apart the binding 5. In this case, the prefabricated unit 30 comprises—as has been illustrated by way of example in FIGS. 4 and 5—a carrier 9 and a binding 5, which is provided with a bow 7 and is formed from a thread-like or strip-like auxiliary packaging means 6.

The retaining arrangement 101 comprises a top retaining plate 103 and a bottom retaining plate 104. The two plates 103 and 104 are arranged essentially horizontally one above the other, it being possible to adjust their distance from one another. For this purpose, the top retaining plate 103 is fastened on an essentially vertical linear guide (movement direction in accordance with arrow RI). The two retaining plates 103, 104 can be rotated or pivoted together in the plane in which they extend by means of a rotary drive 106 (movement direction in accordance with arrow R2). The packaging container 1 or the prefabricated unit 30 may be secured (clamped) between the retaining plates 103, 104, it being possible, since the distance of the retaining plates 103, 104 from one another can be adjusted, to carry out an adaptation to the height H of the packaging container 1 or to the thickness $D_T$ of the carrier 9.

In order that there is sufficient free space available for the binding 5 and for the bow 7 when the prefabricated unit 30 is secured in the retaining arrangement 101, it is preferably possible to provide, on the mutually facing sides of the plates 103, 104, channels and a cutout which correspond respectively to the course taken by the binding 5 and the position of the bow 7 on the prefabricated unit 30. For the same purpose, it is also possible for the carrier 9 to have a through-passage at the location where the bow 7 comes to rest in the prefabricated unit 30.

The number of movable grippers 102 for gripping the binding 5 may differ as required. In the refinement illustrated, seven grippers 102 are provided for gripping the cross-binding, to be precise a first gripper module 107 of three grippers 102 in the region of the top retaining plate 103, a second gripper module 108 of three grippers 102 in the region of the bottom retaining plate 104 and a third gripper module 109 of one gripper 102 in a region outside the retaining plates 103, 104. The grippers 102 of the first module 107 and of the second module 108 are positioned in accordance with the course taken by the binding 5 on the prefabricated unit 30. They grip through the retaining plates 103, 104 from above and beneath and can be moved together with the retaining plates 103, 104. In addition to their capacity for executing the gripping movement, they may thus have a maximum of two degrees of freedom of movement—a degree of freedom for translatory movement R1 (effected by the linear guide 105) and a degree of freedom for the rotary movement R2 (effected by the rotary drive 106). In order to adjust the distance between the plates 103, 104, it is sufficient here if just one retaining plate (e.g., as is illustrated the top retaining plate 103 including the grippers 102) can be displaced to different heights, with the result that, in this case, the number of degrees of freedom in the bottom gripper module 108 is reduced by 1.

The gripper 102 of the third gripper module 109 can be moved such that, in addition to its possible gripping movement, it can execute an advancement movement to the prefabricated unit 30 positioned in the retaining arrangement 101 and a rotary movement about an essentially horizontal axis. It thus has three degrees of freedom of movement, to be precise for translatory movements in two directions (effected, on the one hand, by an essentially horizontal linear guide 110—movement direction in accordance with arrow R3—and, on the other hand, by an essentially vertical linear guide 111—movement direction in accordance with arrow R4) and for the rotary movement (effected by a rotary drive 112—movement direction in accordance with arrow R5).

A framework 113—as FIG. 6 shows—serves for fastening the above described individual parts of the production arrangement according to the invention.

FIGS. 7 to 10 illustrate the functioning of the production arrangement according to the invention.

The production essentially comprises, in order to transfer the auxiliary packaging means 6 from the carrier 9 to the packaging container 1, a prefabricated unit 30, which comprises the carrier 9 and the binding 5, which is provided with the bow 7 and is formed from the thread-like or strip-like auxiliary packaging means 6, being fed to the production apparatus 100 and fixed in the retaining arrangement 101, the binding 5 first of all being gripped by the movable grippers 102 and then being raised up from the carrier 9 by the height H of the packaging container 1. Thereafter, the carrier 9 is removed and the packaging container 1 is brought between the (spread-apart) binding 5 which has been gripped by the grippers 102 and raised up. The binding 5 is then positioned correctly on the packaging container 1 and, finally, the binding 5 is released from the grippers 102, with the result that the finished packaging container 1 can be removed from the production apparatus 100.

Figure 7:
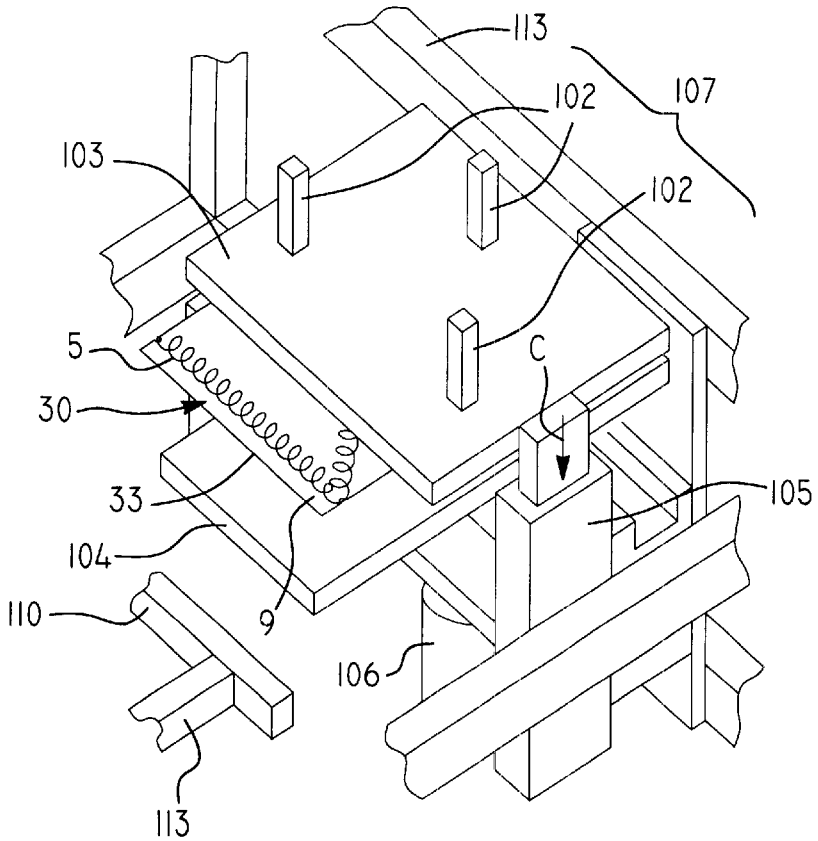
FIGS. 7 to 10 are enlarged detailed views of the production arrangement according to the invention, and illustrated in FIG. 6, in different operating phases.

FIG. 7 shows a first operating step for this. First of all, the prefabricated unit 30 (FIG. 4) is positioned on the bottom retaining plate 103. That end side of the carrier 9 which is designated 12 in FIG. 4 comes to rest on the side of the framework 113, as is illustrated in FIG. 7; the opposite end side, which is designated 33 in FIG. 7, is illustrated as projecting out between the two retaining plates 103, 104.

Thereafter, by virtue of a movement of the vertical linear guide 105, the top retaining plate 103 is moved down in the direction of the bottom retaining plate 104 (arrow C) until the two plates 103, 104 are located one upon the other and thus fix the carrier 9. During this linear movement, the grippers 102 of the first and second gripper modules 107, 108 are opened, in order then, in the next operating step, to be able to grip the binding 5 at the envisaged positions from above and from beneath.

Figure 8:
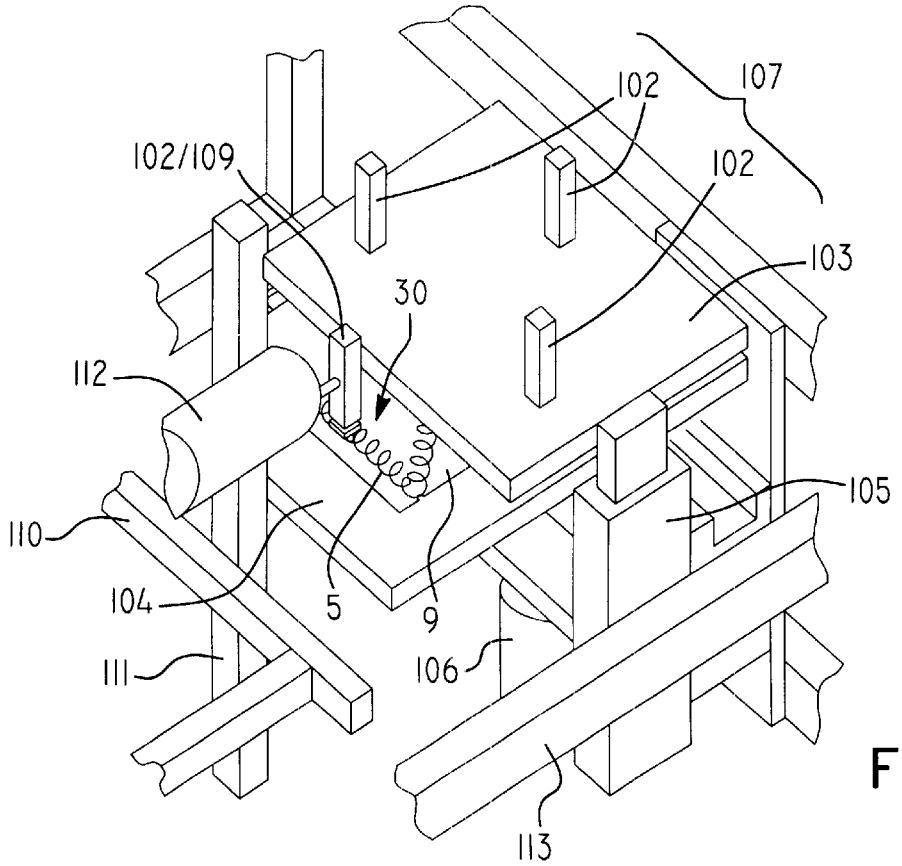

This has taken place in the operating phase shown in FIG. 8. Since the binding 5 is still fastened on the carrier 9, and it is thus the case that no opening has formed for accommodating the packaging container 1, then, with the aid of the two linear guides 110, 111 for the gripper 102 of the third gripper module 109, the latter moves to a position of the binding 5 which is located approximately in the center of the carrier 9 (according to FIG. 4 in the section which is located between the two lateral cutouts 16 and 17). At the same time, the gripper 102 of the third gripper module 109 is opened.

Figure 9:
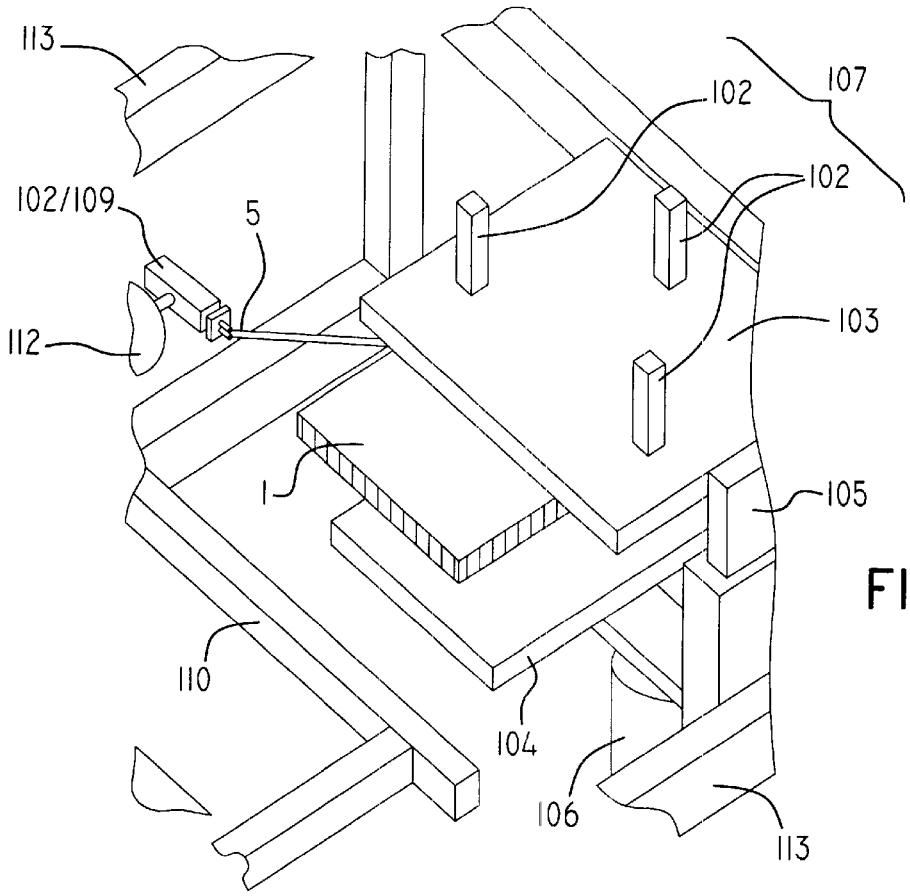
Figure 10:
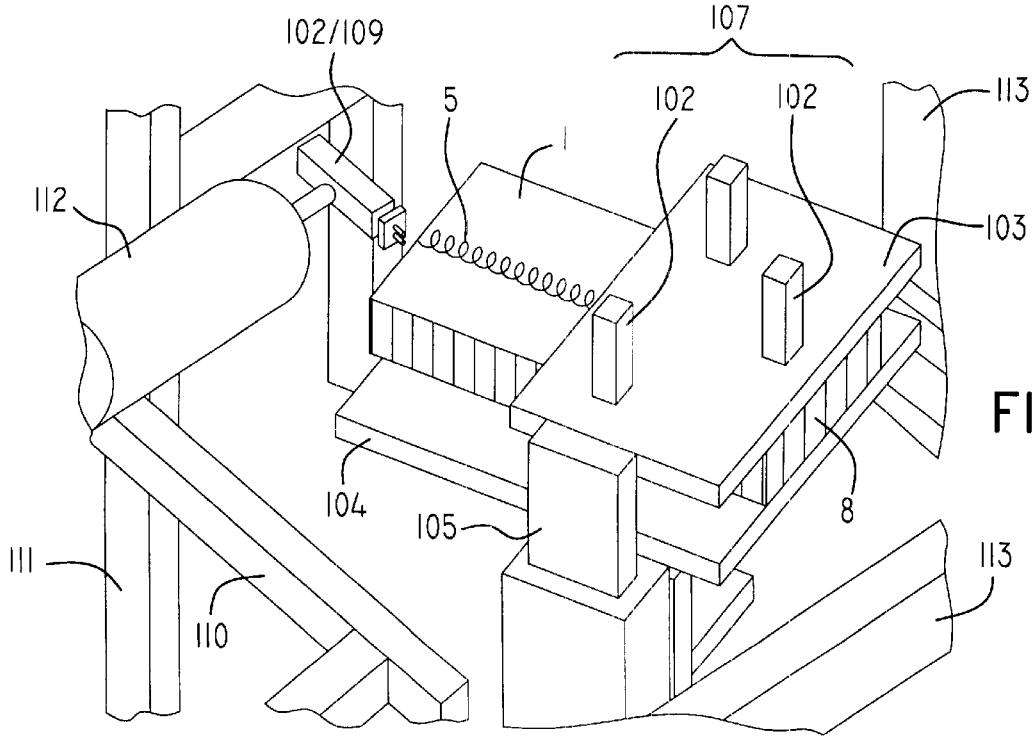

The auxiliary fastening means 6 (the string) is then gripped simultaneously at seven points by all the grippers 102. The top retaining plate 103 is then moved upwards approximately by the height H of the packaging container 1 and the binding 5 is thus spread apart. At the same time, the gripper 102 of the third module 109 moves to the side and is rotated approximately through 90° by the rotary drive 112. The binding 5 is thus opened such that the packaging container 1 can be conveyed in, as FIG. 9 shows. The carrier 9 is removed before this takes place.

Once the packaging container 1 has been positioned between the two plates 103, 104, said packaging container is already enclosed by the binding 5 on three sides (as seen in plan view), e.g. on an end side 8 and on two longitudinal sides. The rotary drive 106 then causes the bottom and the top retaining plates 103, 104 to be rotated along with the packaging container 1 located between them, such that that section of the auxiliary fastening means 6 which is retained by the gripper 102 of the third module 109 is drawn over the last side, which is not yet enclosed by the binding 5.

In order to remove the finished packaging container 1, and in order to allow the above described steps to be repeated for the purpose of producing a new packaging container 1, a last operating step of the production apparatus 100 according to the invention involves the grippers 102 opening and moving into their starting position.

Rather than being restricted to the exemplary embodiment described, the invention also covers all the refinements which act equivalently within the meaning of the invention. For example, the planar contour of the packaging containers 1 may also be of triangular, hexagonal, octagonal or round, rather than rectangular, design. As has already been mentioned, it is also possible to execute another form of binding 5, e.g. diagonal binding or triangular binding, without going beyond the scope of the invention.

In these cases, the configuration of the corresponding carriers 9, of the prefabricating arrangement 10, including the position of the cutouts and recesses possibly provided therein, and the number and position of grippers 102 of the production apparatus 100 are then to be adapted correspondingly to the shape of the packaging container and/or to the form of binding 5.

The bow 7, rather than having to be tied using the auxiliary packaging means 6, may also be applied subsequently to the auxiliary packaging means 6 or fastened thereon. If it is not intended to use any string for the binding 5, the cutouts 13, 16, 17 provided on the carrier 9 may advantageously be adapted to the shape and thickness of the corresponding auxiliary packaging means 6.

In order for that section of the auxiliary fastening means 6 which is retained by the gripper 102 of the third module 109 to be drawn over the last side, which is not yet enclosed by the binding 5, it is not absolutely necessary for the bottom and the top retaining plates 103, 104 to be rotated with the packaging container 1 located between them; rather, it would also be possible for the grippers 102 of the third gripper module 109 to be rotated or pivoted. Correspondingly, it would then be possible to dispense with the rotary drive 106 for the plates 103, 104, although it would then be necessary to provide a rotary drive for rotating the gripper 102 about an essentially vertical axis. However, the above described variant is preferred because it is distinguished by a higher level of movement stability and thus ensures a constantly high quality in production, which is to be ensured, in general, by the production apparatus 100 according to the invention.

In order to provide for the feed and removal (not described specifically above) of the packaging container 1 and for the feed of the prefabricated unit 30 and removal of the carrier 9, it is possible to use various technical solutions in the production apparatus 100 according to the invention. For example, a pneumatic sucker may be provided in order to remove the packaging container 1. The feed of the prefabricated unit 30 and of the packaging container 1, and the removal of the carrier 9, may advantageously be carried out in each case via gripper arms of corresponding feed and removal apparatuses. It is favorable in manufacturing terms here if there are provided a plurality of production apparatuses 100 which can execute the above described operating steps in cyclically-staggered manner and can thus be served alternately in each case by the gripper arms of the feed and removal apparatuses.

The foregoing discussion discloses and describes a preferred embodiment of the invention. One skilled in the art will readily recognize from such discussion, and from the accompanying drawings and claims, that changes and modifications can be made to the invention without departing from the true spirit and fair scope of the invention as defined in the following claims.

List of designations

| | |
|---|---|
| 1 | Packaging container |
| 2 | Base part of 1 |
| 3 | Lid part of 1 |
| 4 | Sleeve around 1 |
| 5 | Binding comprising 6 |
| 6 | Auxiliary packaging means |
| 7 | Bow |
| 8 | End side of 1 |
| 9 | Carrier |
| 10 | Prefabricating arrangement |
| 11 | Corner of 1 |
| 12 | End side of 9 |
| 13 | Cutout in 12 |
| 14 | Longitudinal side of 9 |
| 15 | Longitudinal side of 9 |
| 16 | Cutout in 14 |
| 17 | Cutout in 15 |
| 18 | Recess in 14 |
| 19 | Recess in 15 |
| 20 | End side of 10 |
| 21 | End side of 10 |
| 22 | Cutout in 20 |
| 23 | Cutout in 21 |
| 24 | Longitudinal side of 10 |
| 25 | Longitudinal side of 10 |
| 26 | Recess in 24 |
| 27 | Recess in 25 |
| 28 | Oblique side between 21 and 24 |
| 29 | Edge between 21 and 28 |
| 30 | Prefabricated unit comprising 9, 5 and 7 |
| 31 | Loop of 5 |
| 32 | Crossover point of 5 |
| 33 | End side of 9 |
| 100 | Production apparatus |
| 101 | Retaining arrangement of 100 |
| 102 | Gripper |
| 103 | Top retaining plate |
| 104 | Bottom retaining plate |
| 105 | Vertical linear guide for 103 |

-continued

| List of designations | |
|---|---|
| 106 | Rotary drive for 103, 104 |
| 107 | First gripper module |
| 108 | Second gripper module |
| 109 | Third gripper module |
| 110 | Horizontal linear guide for 109 |
| 111 | Vertical linear guide for 109 |
| 112 | Rotary drive for 109 |
| 113 | Framework of 100 |
| $A_{VK}$ | Shortened distance between 20 and 21 |
| B | Width of 1 |
| $B_T$ | Width of 9 |
| $B_{VK}$ | Width of 10 |
| C | Opening movement of 101 |
| F | Extendibility of 6 |
| $D_T$ | Thickness of 9 |
| $D_{VK}$ | Thickness of 10 |
| H | Height of 1 |
| L | Length of 1 |
| $L_T$ | Length of 9 |
| $L_{VK}$ | Length of 10 |
| R1 | Translatory movement for 105 |
| R2 | Rotary movement for 106 |
| R3 | Translatory movement for 110 |
| R4 | Translatory movement for 111 |
| R5 | Rotary movement for 112 |
| X | Position of bow (distance between 7 and 8) |
| Y | Unextended length of 6 |
| Z | Extended length of 6 |

We claim:

1. A method of producing a packaging container with a binding and decorating the packaging container with a bow, the method comprising:

prefabricating a carrier with an elastically extendable auxiliary packaging means;

providing the carrier with a binding having a bow and being made from the elastically extendible auxiliary packaging means;

positioning the carrier on one of a top side and an underside of the packaging container;

at least partially guiding the packaging container at least partially between the binding and the carrier;

slipping the binding off from the carrier;

slipping the binding over the packaging container; and removing the carrier from the binding and the packaging container.

2. The method according to claim 1 further comprising pre-stressing the auxiliary packaging means prior to prefabricating the carrier.

3. The method according to claim 1 further comprising the binding being selected from the group consisting of a diagonal binding and a triangular binding.

4. The method according to claim 1 further comprising tying the bow using the auxiliary packaging means.

5. A method for producing a packaging container with a binding having an auxiliary packaging means and decorating the packaging container with a bow, the method comprising:

prefabricating a carrier with an auxiliary packaging means;

providing a production apparatus;

feeding a prefabricated unit including the carrier and the binding having the bow and being formed from the auxiliary packaging means to the production apparatus;

fixing the prefabricated unit in a retaining arrangement of the production apparatus;

gripping the binding with movable grippers;

spreading the binding apart with the grippers;

raising the binding up from the carrier;

removing the carrier;

positioning the packaging container between the spread-apart binding gripped by the grippers;

positioning the binding correctly on the packaging container;

releasing the binding from the grippers; and removing the finished packaging container from the production apparatus.

6. The method according to claim 5 further comprising pre-stressing the auxiliary packaging means prior to prefabricating the carrier.

7. The method according to claim 5 further comprising the binding being selected from the group consisting of a diagonal binding and a triangular binding.

8. The method according to claim 5 further comprising tying the bow using the auxiliary packaging means.

9. A method of producing a packaging container with a binding having an auxiliary packaging means and decorating the packaging container with a bow, the method comprising:

prefabricating a carrier with an auxiliary packaging means;

transferring the auxiliary packaging means from the carrier to a packaging container, and wherein prefabricating the carrier with an auxiliary packaging means further comprises:

providing a prefabricating arrangement;

bounding the auxiliary packaging means around the prefabricating arrangement;

providing the auxiliary packaging means with a bow; and transferring the auxiliary packaging means from the prefabricating arrangement to the carrier.

10. The method according to claim 9, wherein transferring the auxiliary packaging means from the prefabricating arrangement to the carrier further comprises:

positioning the carrier on one of the top side and an underside of the prefabricating arrangement;

at least partially guiding the carrier at least partially between the auxiliary packaging means and the prefabricating arrangement;

slipping the auxiliary packaging means off from the prefabricating arrangement;

slipping the auxiliary packaging means over the carrier; and removing the prefabricating arrangement from the auxiliary packaging means and the carrier.

11. The method according to claim 9 further comprising pre-stressing the auxiliary packaging means prior to prefabricating the carrier.

12. The method according to claim 9 further comprising cross-binding the binding.

13. The method according to claim 12, wherein in order to bind a cuboidal box as a packaging container having a length L, a width B, and a height H, and in order to decorate the same with a bow which is located at a distance X from an end side of the packaging container, use is made of an auxiliary packaging means which has at least approximately a percentage extendibility by an amount F, it being possible for this amount F to be calculated as $$F = \left(\frac{Z}{Y} - 1\right) * 100\%$$

and it being possible for Z to be calculated as $$Z = (0.25B^2 + L^2)^{0.5} + [0.25B^2 + (L - X)^2]^{0.5} + H$$

and Y as $$Y = 2L - X + H.$$

14. The method according to claim 10 further comprising the binding being selected from the group consisting of a diagonal binding and a triangular binding.

15. The method according to claim 9 further comprising tying the bow using the auxiliary packaging means.

* * * * *